US009270053B2

(12) United States Patent
Hsu et al.

(10) Patent No.: US 9,270,053 B2
(45) Date of Patent: Feb. 23, 2016

(54) ELECTRICAL CONNECTOR ASSEMBLY WITH JUMPER ELEMENT ASSEMBLED THEREON

(71) Applicant: HON HAI PRECISION INDUSTRY CO., LTD., New Taipei (TW)

(72) Inventors: Shuo-Hsiu Hsu, New Taipei (TW); Hao-Yun Ma, San Jose, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 52 days.

(21) Appl. No.: 14/320,888

(22) Filed: Jul. 1, 2014

(65) Prior Publication Data

US 2016/0006175 A1 Jan. 7, 2016

(51) Int. Cl.

*H01R 13/10* (2006.01)
*H01R 13/635* (2006.01)
*H01R 13/629* (2006.01)

(52) U.S. Cl.

CPC ..... *H01R 13/635* (2013.01); *H01R 13/629* (2013.01)

(58) Field of Classification Search

CPC ..... H01R 13/658; H01R 13/112; H01R 13/6275; H01R 13/6272; H01R 23/7073; H01R 23/725

USPC ..... 439/682, 660, 357

See application file for complete search history.

(56) References Cited

U.S. PATENT DOCUMENTS

| | | | | |
|---|---|---|---|---|
| 7,112,102 | B2 * | 9/2006 | Masaki | H01R 12/75 439/660 |
| 7,828,585 | B2 * | 11/2010 | Kurimoto | H01R 13/02 439/357 |
| 9,048,569 | B2 * | 6/2015 | Chen | H01R 12/716 |
| 2013/0143444 | A1 * | 6/2013 | Chen | H01R 13/518 439/626 |

FOREIGN PATENT DOCUMENTS

| | | |
|---|---|---|
| TW | M429188 | 5/2012 |

* cited by examiner

*Primary Examiner* — Hien Vu

(74) *Attorney, Agent, or Firm* — Wei Te Chung; Ming Chieh Chang

(57) ABSTRACT

An electrical connector assembly comprises an insulating housing defining a cavity and a pocket beside the cavity, a bracket located at the outside of the insulating housing, and a jumper element assembled into the pocket. The bracket comprises a latch extending into the pocket while the jumper element comprises an elastic member elastically received in the pocket and urging the jumper element to move upwardly. The latch of the bracket engages the jumper element to retain the jumper element into the pocket, when releasing the latch, the elastic member ejects the jumper element upwardly out from the pocket.

10 Claims, 10 Drawing Sheets

ELECTRICAL CONNECTOR ASSEMBLY WITH JUMPER ELEMENT ASSEMBLED THEREON

BACKGROUND OF THE INVENTION

1. Field of the Invention

The present disclosure relates to an electrical connector assembly, and more particularly to an electrical connector assembly connecting a module with a printed circuit board (PCB), and having a jumper element assembled thereon.

2. Description of the Related Art

Various electrical connectors are widely used in computers and other electronic devices for establishing electrical connections between two electronic components, such as two packages, a package and a printed circuit board (PCB) and so on. An electrical connector for connecting a package typically comprises a socket defining an accommodating cavity for receiving the package. By the development of technology, the electrical connector further comprises some pockets for receiving some small-size elements, such as lens assemblies, for optical communication. When removing the small-size elements, the user has to move the small-size elements manually by grasping the small-size elements with fingers and then pull them out. However, with the miniaturized tendency of the electrical connector, the size of the electrical connector becomes smaller and smaller, so it is very difficult to pull the small-size elements out manually from a small pocket. More serious, the small-size elements or the electrical connector may be destroyed.

In view of the above, an improved electrical connector is desired to overcome the problems mentioned above.

SUMMARY OF THE INVENTION

Accordingly, an object of the present disclosure is to provide an electrical connector assembly with a jumper element and convenient the removal of the jumper element.

In order to achieve the object set forth, an electrical connector assembly with a jumper element having an elastic member retained thereon is provided. The electrical connector assembly comprises an insulating housing having a cavity and a pocket beside the cavity, a bracket located at the outside of the insulating housing, and a jumper element assembled into the pocket. The bracket comprises a latch extending into the pocket, the jumper element comprises an elastic member elastically received in the pocket and urging the jumper element to move upwardly. The latch of the bracket engages the jumper element to retain the jumper element into the pocket, when releasing the latch, the elastic member ejects the jumper element upwardly out from the pocket.

DESCRIPTION OF PREFERRED EMBODIMENT

Figure 1:
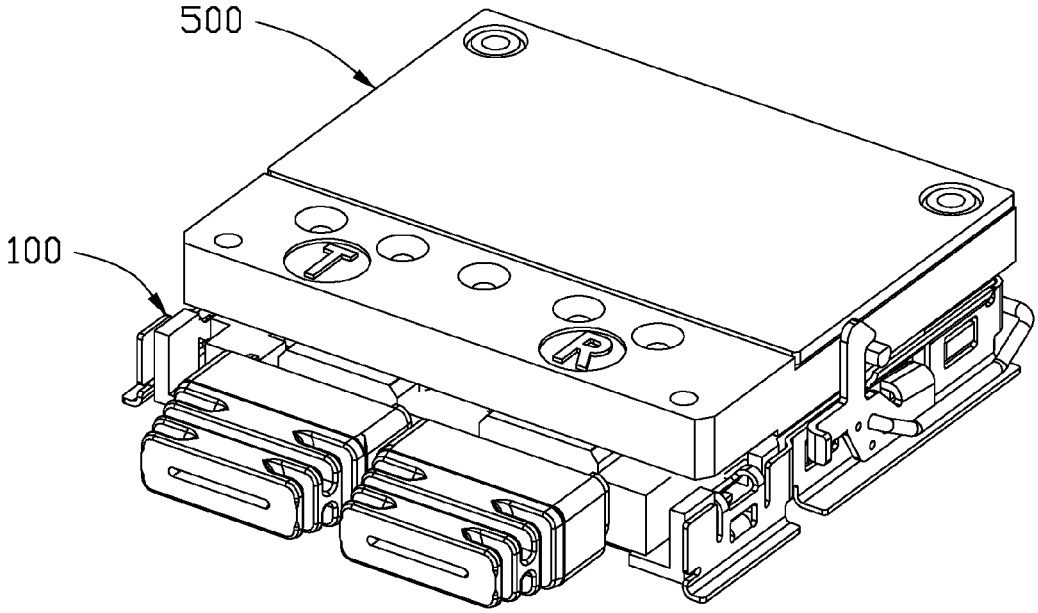
FIG. 1 is an assembled, perspective view of an electrical connector assembly in accordance with a preferred embodiment of the present disclosure with a module.

Reference will now be made to the drawings to describe the present disclosure in detail.

FIGS. 1 to 8 show a first embodiment of the present disclosure. Referring to FIGS. 1 to 4, an electrical connector assembly 100 for electrically connecting a module 500 with a printed circuit board (PCB) (not show) is provided. The electrical connector assembly 100 comprises an insulating housing 2, a plurality of contacts (not show) received in the insulating housing 2, a bracket 1 surround the insulating housing 2 and a jumper element 3 assembled onto the insulating housing 2.

Figure 2:
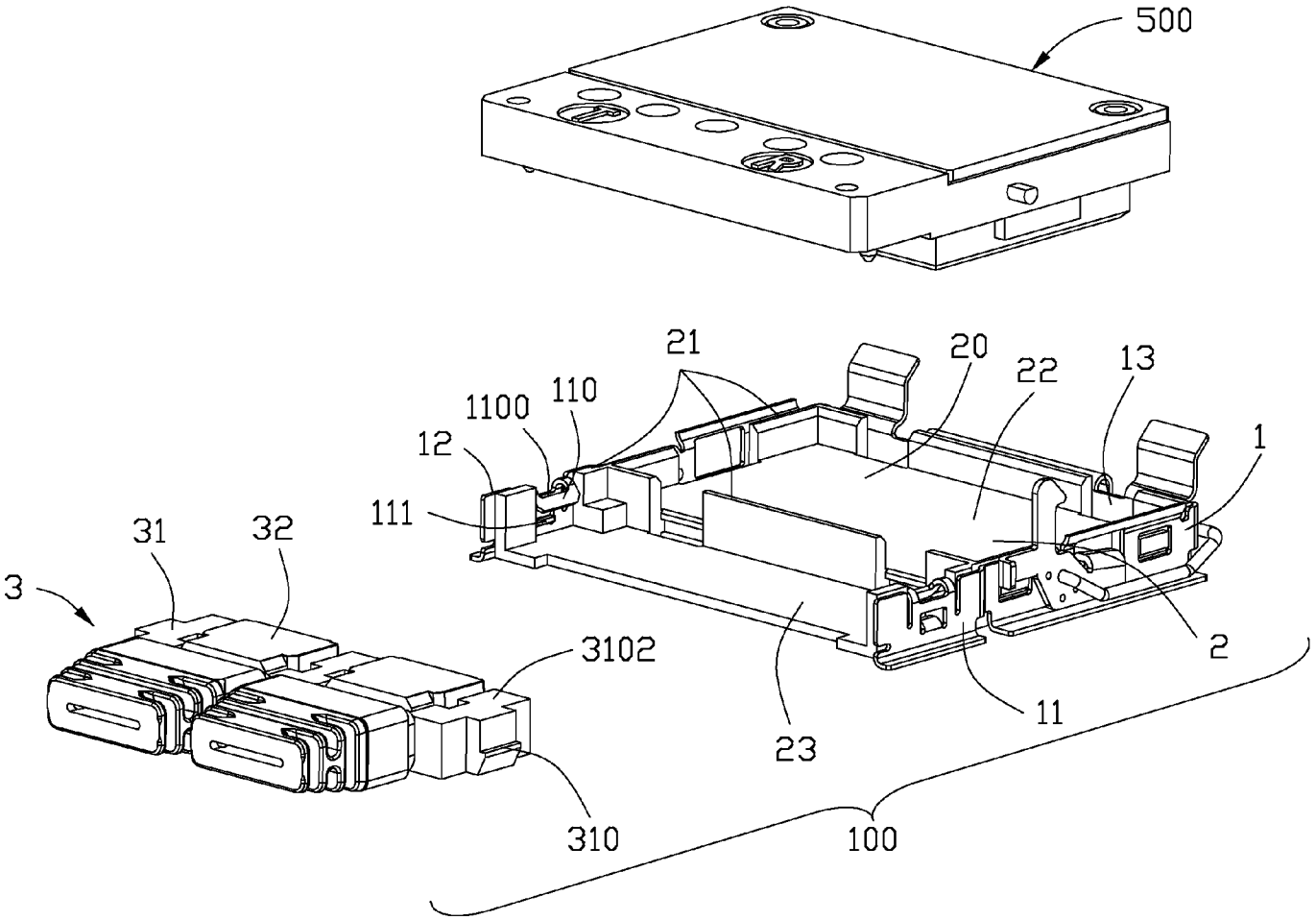
FIG. 2 is an exploded, perspective view of the electrical connector assembly and the module shown in FIG. 1.
Figure 3:
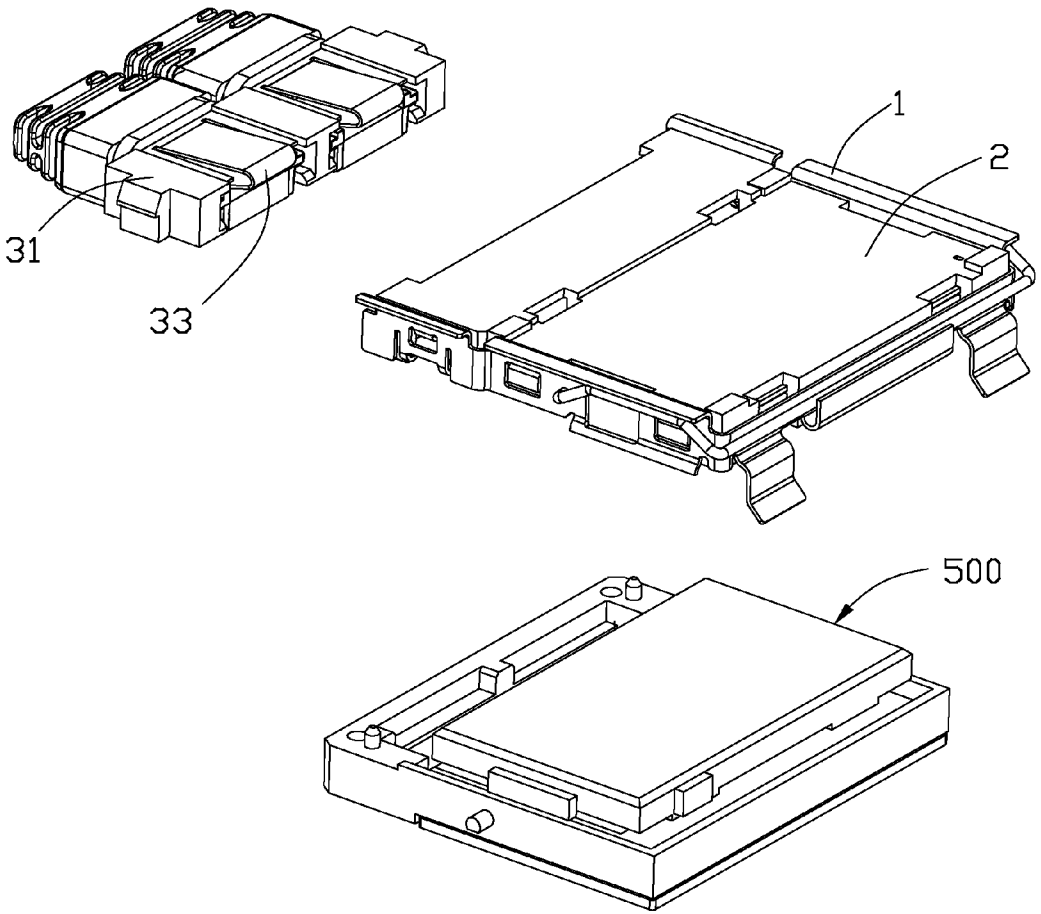
FIG. 3 is another view of the electrical connector assembly and the module shown in FIG. 2.
Figure 4:
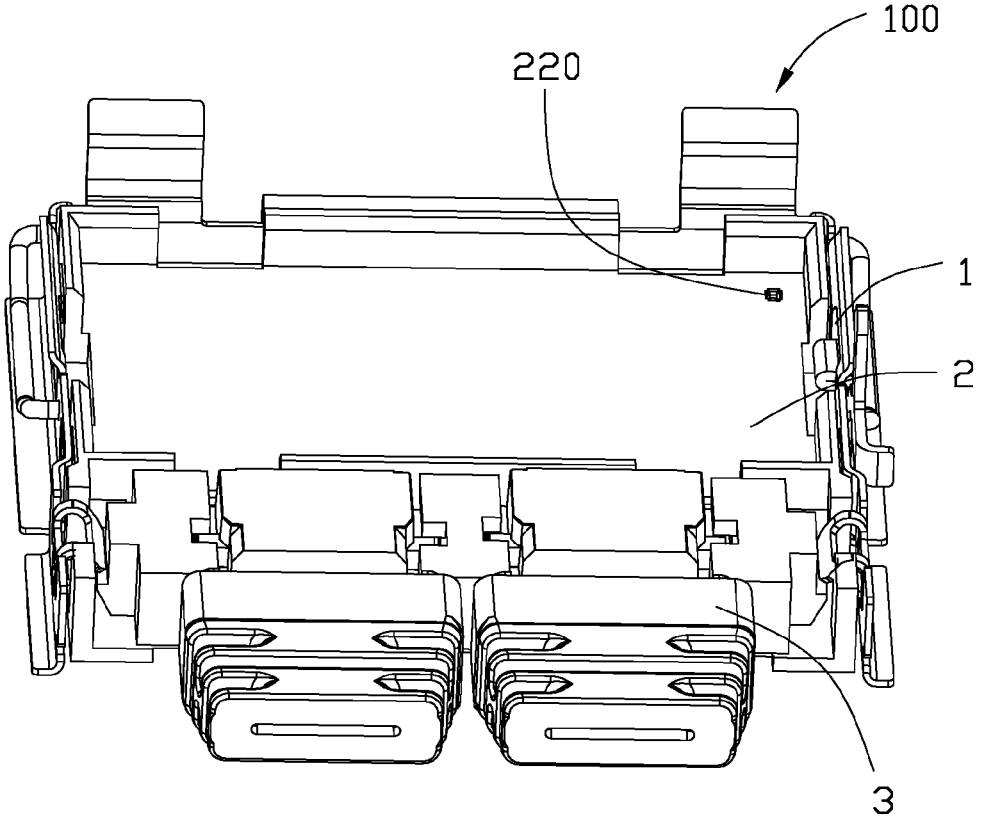
FIG. 4 is a perspective view of the electrical connector assembly shown in FIG. 1.

Referring to FIG. 2 and FIG. 4, the insulating housing 2 comprises a bottom wall 20 and a plurality of side walls 21. The bottom wall 20 and the side walls 21 define a cavity 22 and a pocket 23. The pocket 23 locates beside the cavity 22 for receiving the jumper element 3 and comprises an opening at a front end far away from the cavity 22 for the jumper element 3 extending out. The cavity 22 comprises a plurality of receiving holes 220 for receiving said contacts.

The bracket 1 is a U-shaped metallic frame, comprising a first side 11, a second side 12 opposite to the first side 11 and a third side 13 connecting the first and second sides 11, 12. The third side 13 locates on a rear end opposite to the opening of the pocket 23. Closing to the front end, each of the first and second sides 11, 12 comprises a latch 110 and a stopper portion 111 extending towards the pocket 23. The latch 110 comprises a slot 1100 for a tool, such as a screwdriver, insertion. The stopper portion 111 locates under the slot 1100 for supporting the tool to constrain the position of the tool.

Figure 5:
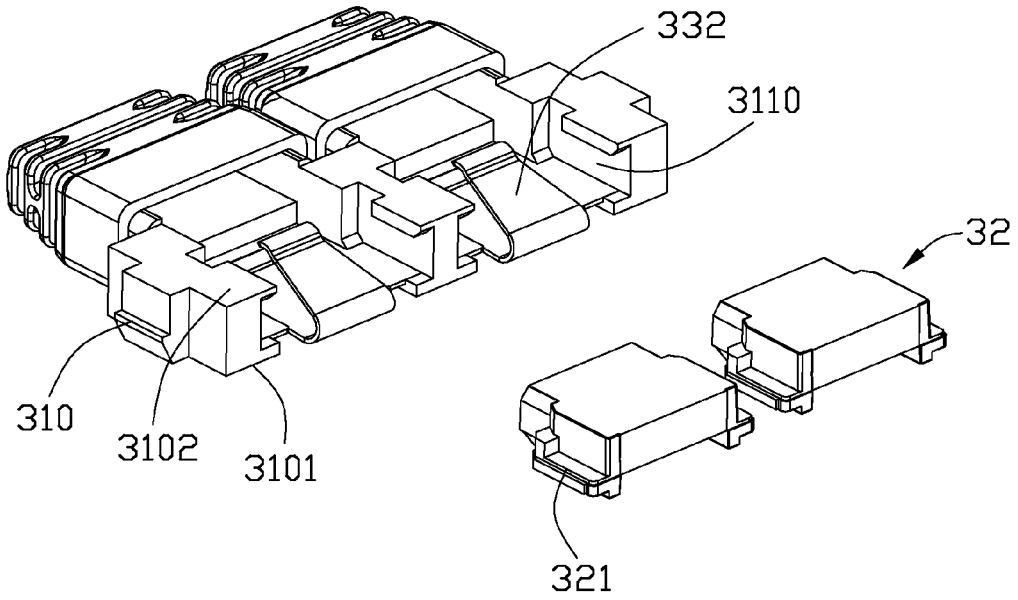
FIG. 5 is an exploded, perspective view of a jumper element shown in FIG. 2.
Figure 6:
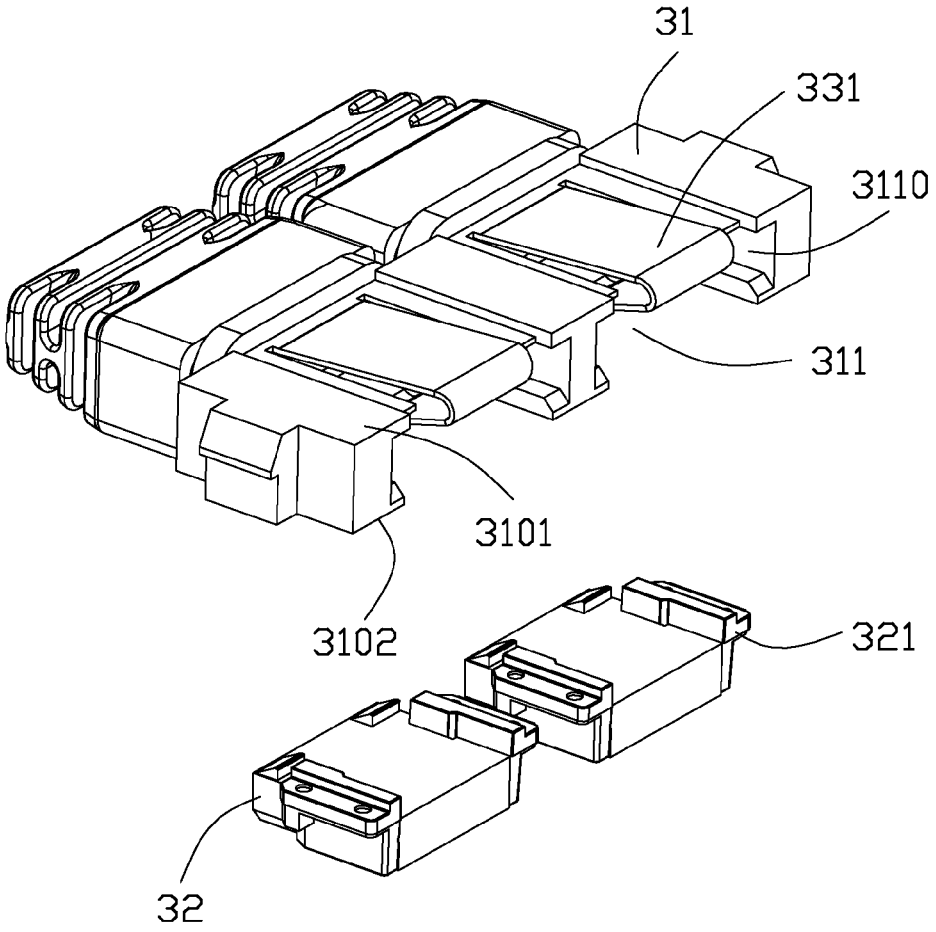
FIG. 6 is another view of the jumper element shown in FIG. 5.

Referring to FIGS. 5 and 6, the jumper element 3 comprises a seat 31 and two mating members 32 assembled onto the seat 31. The seat 31 comprises a stepped portion 310 at two opposite ends for engaging with the latches 110 of the bracket 1. The seat 31 comprises a top surface 3102, a bottom surface 3101 opposite to the top surface 3102 and a pair of passageways 311 going through the top and bottom surfaces 3102, 3101 for receiving the mating members 32. Each of the passageways 311 comprises a pair of sliding ways 3110 for the mating member 32 sliding and retaining into the passageway 311 while the mating member 32 comprises a pair of sliding protrusions 321 matching with the sliding ways 3110. The seat 31 further comprises a pair of elastic members 33 insert-molded with the seat 31. The elastic member 33 comprises a lower arm 331 extending obliquely and downwardly for pushing the bottom wall of the pocket 23 and an upper arm 332 extending obliquely and upwardly into the passageways 311 for pushing the mating members 32. When the mating member 32 is assembled on the seat, the lower arm 331 of the elastic member 33 extends beyond the bottom surface 3101 of the seat 31, and a top of the mating member 32 locates beyond the top surface 3102 of the seat 31, i.e. the lowest position of the elastic member 33 is lower than the bottom surface 3101 and the highest position of the mating member 32 is higher than the top surface 3102.

Figure 7:
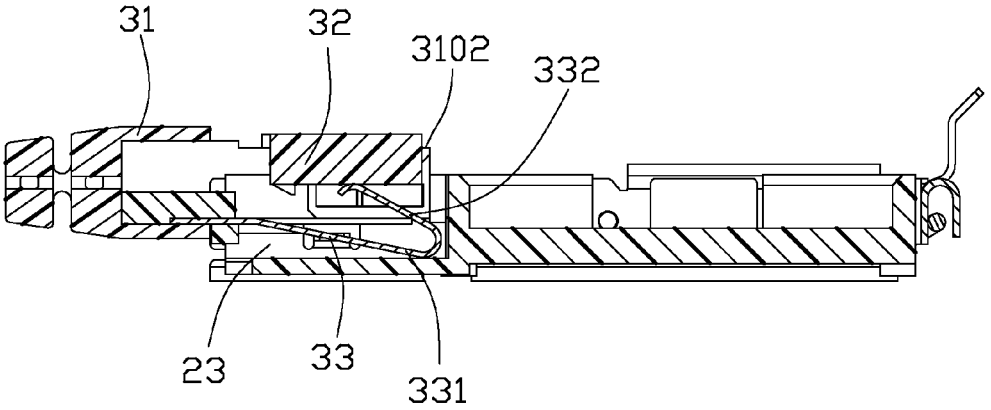
FIG. 7 is a cross sectional view of the electrical connector assembly before the jumper element is locked in the electrical connector.
Figure 8:
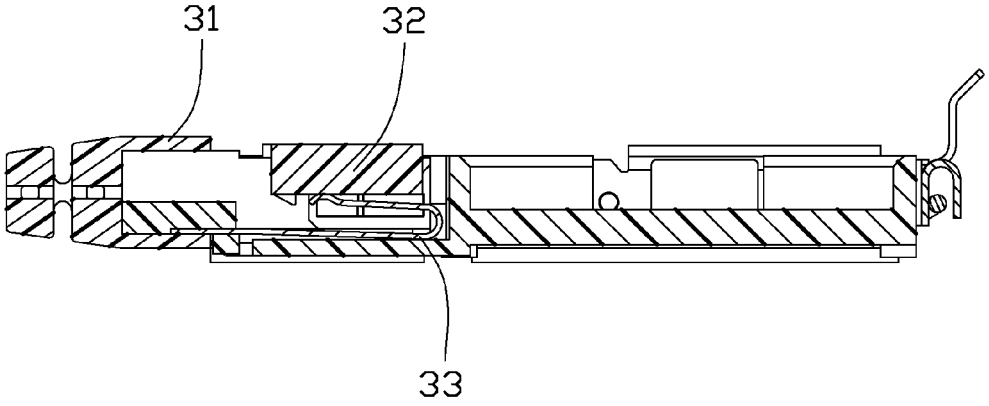
FIG. 8 is a similar view as shown in FIG. 7, wherein the jumper element is locked in the electrical connector.
Figure 9:
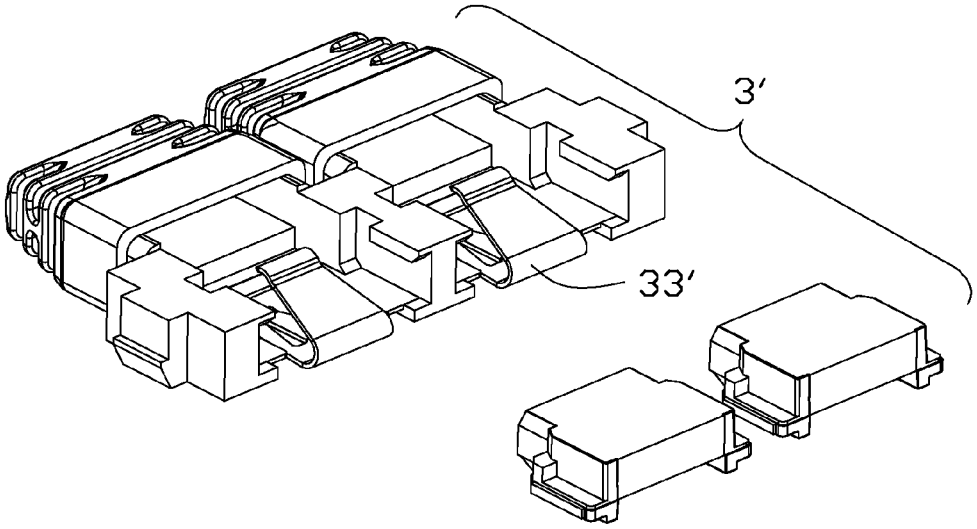
FIG. 9 is an exploded, perspective view of a jumper element in accordance with another embodiment.
Figure 10:
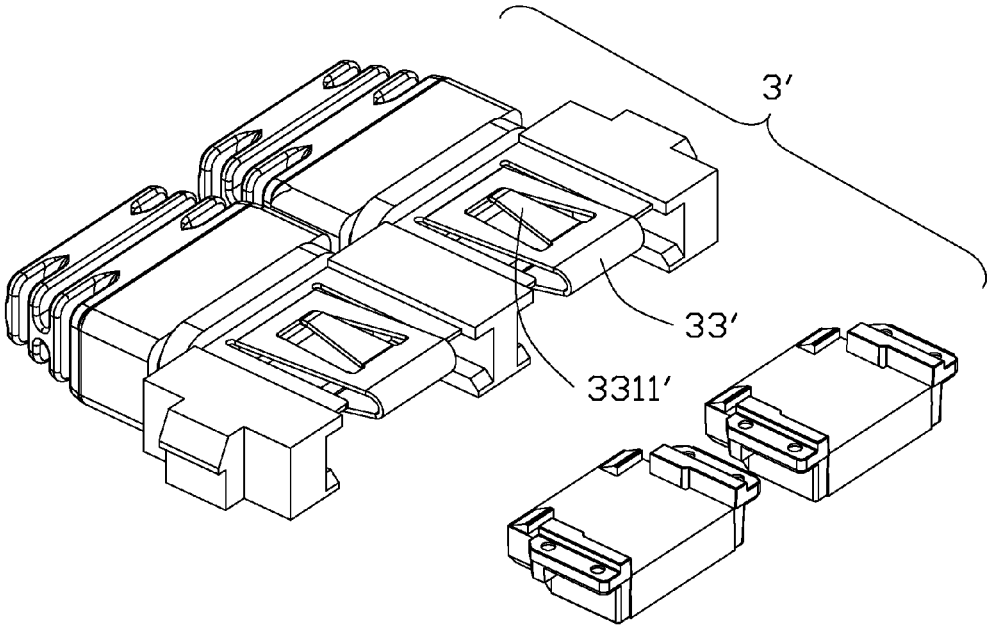
FIG. 10 is another view of the jumper element shown in FIG. 9.

Referring to FIGS. 7 and 8, when assembling, the mating member 32 and the seat 31 are assembled together forming the jumper element 3. The bracket 1 and the insulating housing 2 are assembled together with the latch 110 and the stopper portion 111 extending into the pocket 23 of the insulating housing 2. The jumper element 3 is assembled onto the pocket 23 in an up-to-down direction. With the jumper element 3 moves downwardly, the elastic member 33 is pressed by the bottom wall of the pocket 23 and deforms elastically, and finally the latch 110 engages the stepped portion 310, thus, the jumper element 3 is retained thereon. When used, the module 500 is assembled thereon in the up-to-down direction. The module 500 comprises one portion received in the cavity 22 and another portion mating with the jumper element 3. As the top of the mating member 32 is higher than the top surface 3102, the mating member 32 can match with the module 500 tightly so as to establish a stable connection therebetween. When removing, a tool, such as a screwdriver, can be inserted into the slot 1100 of the latch 110 and stopped by the stopper portion 111, the tool drives the latch 110 to deform elastically and disengage the stepped portion 310 of the jumper member 3. And then, the elastic member 33 bounces the jumper element 3 out from the pocket 23. Therefore, the removal of the jumper member 3 becomes easy.

FIG. 8 shows another embodiment of the present disclosure where the elastic member 33' is different from that in the first embodiment. Compare with the elastic member 33 in the first embodiment, the elastic member 33' in this embodiment further comprises an assistant arm 3311' stamped from the lower arm and further extending downwardly for increasing the ejection distance of the jumper element 3'.

According to the above described embodiments, an electrical connector assembly 100 with a jumper element 3, 3' assembled thereon is provided. The jumper element 3, 3' comprises an elastic member 33, 33' for ejecting the jumper element 3, 3' out from a pocket 23 so that the jumper element 3, 3' can be removed easily from the pocket 23.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

an insulating housing comprising a cavity and a pocket at a front end of the insulating housing beside the cavity;

a U-shaped metallic bracket surrounding the insulating housing comprising a metal latch extending into the pocket; and a jumper element assembled into the pocket, the jumper element comprising an elastic member elastically received in the pocket;

wherein the latch of the bracket engages with the jumper element to retain the jumper element into the pocket, when releasing the latch, the elastic member pushes the jumper element to move upwardly from the pocket;

wherein the jumper element comprises a seat defining a passageway and a mating member assembled on the passageway, the elastic member comprises an upper arm extending upwardly into the passageway pushing the mating member;

wherein the seat comprises a top surface and a bottom surface opposite to each other, the mating member extends upwardly beyond the top surface while the elastic member comprises a lower arm extending downwardly beyond the bottom surface;

wherein the passageway comprises a pair of sliding ways at two opposite sides while the mating member comprises a pair of sliding protrusions matching with the sliding ways to be assembled and retained thereon; and wherein the latch is a metal plate bent into the pocket, the latch comprises a slot for a tool insertion.

2. The electrical connector assembly as claimed in claim 1, wherein the elastic member further comprises an assistant arm stamped downwardly from the lower arm.

3. The electrical connector assembly as claimed in claim 1, wherein the jumper element comprises a stepped portion for engaging with the latch of the bracket.

4. The electrical connector assembly as claimed in claim 1, wherein the bracket comprises a stopper portion extending into the pocket and located under the slot for constrain the position of the tool.

5. The electrical connector assembly as claimed in claim 1, wherein the pocket comprises an opening at a front end far away from the cavity for the jumper element extending out.

6. The electrical connector assembly as claimed in claim 5, wherein the bracket is U-shaped, the bracket is disconnected at the front end corresponding to the opening of the pocket.

7. An electrical connector assembly comprising:

an insulating housing comprising a pocket at a front end of the insulating housing; and a jumper element assembled into the pocket, the jumper element comprising a seat defining a passageway and a mating member assembled on the seat, the seat further comprising an elastic member for upwardly pushing the mating member;

wherein the seat comprises a top surface and a bottom surface opposite to each other, the elastic member comprises a portion extending downwardly beyond the bottom surface;

wherein the electrical connector assembly further comprises a U-shaped metallic bracket surrounding the insulating housing, the bracket comprises a metal latch with a slot extending into the pocket for locking the jumper element therein;

wherein the elastic member comprises a lower arm extending obliquely and downwardly beyond the bottom surface of the seat and an upper arm extending obliquely and upwardly from the lower arm into the passageway; and wherein the passageway comprises a pair of sliding ways at two opposite sides while the mating member comprises a pair of sliding protrusions matching with the sliding ways to be assembled and retained thereon.

8. The electrical connector assembly as claimed in claim 7, wherein the elastic member further comprises an assistant arm stamped from the lower arm and further extending downwardly.

9. An electrical connector assembly comprising:

a housing forming an upward pocket at a front end of the housing communicating upwardly with an exterior in a vertical direction;

a U-shaped metallic bracket surrounding the housing having a pair of deflectable metal latches having slots located by two sides of the pocket;

a jumper element configured to be downwardly assembled into the pocket in said vertical direction, and equipped with an elastic member deformed in the vertical direction when said jumper is received in the pocket and locked by said latch so as to eject said jumper element when said latch is released;

where said jumper further includes a detachable mating member, and said elastic member experiences more deformation when said mating member is associatively assembled within said jumper;

wherein the elastic member constantly urges the mating member upwardly when said mating member is assembled to the jumper element;

wherein said mating member is configured to be assembled within the jumper element along a front-to-back direction perpendicular to said vertical direction;

wherein said elastic member includes a spring tang constantly downwardly abuts against the housing disregarding whether the mating member is assembled within the jumper element or not.

10. The electrical connector assembly as claimed in claim 9, wherein said elastic member upwardly abuts against the mating member when said mating member is assembled to the jumper element.

* * * * *